US010773841B2

(12) United States Patent
Skonieczny, Jr.

(10) Patent No.: US 10,773,841 B2
(45) **Date of Patent: *Sep. 15, 2020**

(54) TENSIONER/CUTTER TOOL FOR HOSE CLAMPS AND/OR BANDS AND ATTACHMENTS FOR TENSIONER/CUTTER

(71) Applicant: Signode Industrial Group LLC, Glenview, IL (US)

(72) Inventor: Wayne J. Skonieczny, Jr., Cary, IL (US)

(73) Assignee: Signode Industrial Group LLC, Glenview, IL (US)

( * ) Notice: Subject to any disclaimer, the term of this patent is extended or adjusted under 35 U.S.C. 154(b) by 190 days.

This patent is subject to a terminal disclaimer.

(21) Appl. No.: 16/059,362

(22) Filed: Aug. 9, 2018

(65) Prior Publication Data

US 2018/0346160 A1 Dec. 6, 2018

Related U.S. Application Data

(62) Division of application No. 14/676,462, filed on Apr. 1, 2015, now Pat. No. 10,138,010.

(Continued)

(51) Int. Cl.
*B65B 13/02* (2006.01)
*B65B 61/06* (2006.01)

(Continued)

(52) U.S. Cl.
CPC ..... *B65B 13/027* (2013.01); *B25B 25/00* (2013.01); *B25B 25/005* (2013.01);

(Continued)

(58) Field of Classification Search
CPC ..... B65B 13/22; B65B 13/027; B65B 13/185; B65B 13/345; B65B 59/04; B65B 61/06; B25B 25/00; B25B 25/005

(Continued)

(56) References Cited

U.S. PATENT DOCUMENTS 3,570,554 A * 3/1971 Kabel ..... B65B 13/345 140/93.2
3,661,187 A 5/1972 Caveney (Continued)

FOREIGN PATENT DOCUMENTS

EP 0371290 A1 6/1990
EP 0687528 A1 12/1995

OTHER PUBLICATIONS

ITW Strapbinder catalogue entry from http://clamps.itwstrapbinder.com/viewitems/tensioning-tools-for-hose-and-sign-securement/spin-tight-tools.

(Continued)

*Primary Examiner* — Jimmy T Nguyen
(74) *Attorney, Agent, or Firm* — Levenfeld Pearlstein, LLC

(57) ABSTRACT

A tool for tensioning, cutting and/or punching a band of a band-type clamp, a band and buckle attachment, and a band punch attachment are provided. The tool includes a nose piece to receive a tail of the band and a lever pivotably secured to the nose piece. The band and buckle attachment includes a main body having a band guide slot and a blade guide intersecting the band guide slot. A blade is movably positioned in the blade guide. A blade biasing element is positioned between the blade and the main body. The band punch attachment includes a main body having a band guide slot and a punch mechanism rotatably mounted on the main body. The punch mechanism includes a punch guide having a passageway and a punch tool movably positioned in the punch guide. A spring is positioned in the passageway urging the punch tool in a predetermined direction.

20 Claims, 11 Drawing Sheets

Related U.S. Application Data

(60) Provisional application No. 62/001,382, filed on May 21, 2014.

(51) Int. Cl.

| | |
|---|---|
| ***B65B 59/04*** | (2006.01) |
| ***B65B 13/22*** | (2006.01) |
| ***B65B 13/34*** | (2006.01) |
| ***B65B 13/18*** | (2006.01) |
| ***B25B 25/00*** | (2006.01) |

(52) U.S. Cl.
CPC ..... *B65B 13/185* (2013.01); *B65B 13/22* (2013.01); *B65B 13/345* (2013.01); *B65B 59/04* (2013.01); *B65B 61/06* (2013.01)

(58) Field of Classification Search
USPC ..... 100/29, 32
See application file for complete search history.

(56) References Cited

U.S. PATENT DOCUMENTS

| | | | | |
|---|---|---|---|---|
| 3,830,263 | A * | 8/1974 | Benfer | B21F 9/02 140/93.2 |
| 4,093,005 | A | 6/1978 | Eberhardt | |
| 4,321,952 | A * | 3/1982 | Natkins | B65B 67/06 140/123.6 |
| 4,934,416 | A | 6/1990 | Tonkiss | |
| 5,566,726 | A | 10/1996 | Marelin | |
| 5,915,425 | A | 6/1999 | Nilsson et al. | |
| 6,206,053 | B1 * | 3/2001 | Hillegonds | B65B 13/027 140/123.6 |
| 7,299,830 | B2 * | 11/2007 | Levin | B65B 13/027 140/123.6 |
| 10,138,010 | B2 * | 11/2018 | Skonieczny, Jr. | B65B 13/027 |
| 2004/0079436 | A1 * | 4/2004 | Hillegonds | B65B 13/027 140/123.6 |
| 2005/0268983 | A1 | 12/2005 | Levin | |
| 2012/0197256 | A1 * | 8/2012 | Knueppel | A61B 17/8872 606/74 |
| 2013/0269824 | A1 | 10/2013 | Skonieczny, Jr. et al. | |
| 2015/0151862 | A1 * | 6/2015 | Kitago | B65B 13/305 140/93.2 |

OTHER PUBLICATIONS

ITW Strapbinder catalogue entry from http://clamps.itwstrapbinder.com/viewitems/tensioning-tools-for-hose-and-sign-securement/center-punch-tools.

International Search Report for PCT/US2013/036293 dated Jul. 25, 2013.

* cited by examiner

TENSIONER/CUTTER TOOL FOR HOSE CLAMPS AND/OR BANDS AND ATTACHMENTS FOR TENSIONER/CUTTER

CROSS-REFERENCE TO RELATED APPLICATION DATA

This application is a division of U.S. patent application Ser. No. 14/676,462, filed Apr. 1, 2015, which claims the benefit of and priority to Provisional U.S. Patent Application Ser. No. 62/001,382, filed May 21, 2014, the disclosures of which are incorporated herein by reference.

BACKGROUND

The following description relates to a tool for tensioning, cutting and/or punching a hose clamp or band and an attachment for the tool for tensioning, cutting and/or punching the band.

Hoses are often connected to fittings using cam and groove fittings that require a clamp or band to be secured around the hose to secure the hose to the fitting. One example of such a hose to fitting connection is on the end of a water transfer hose.

A typical hose clamp includes a band that is formed into a loop or circle and a seal that holds the loop. The seal encircles the overlapped courses of band. To secure the band onto the hose, a tail end of the band is bent up against the edge of the seal (forming a J-seal) and is cut just beyond the J-seal.

One known tool is described and disclosed in Marelin, U.S. Pat. No. 5,566,726 and includes a screw actuated drive which can be fitted to a hand-held drill. One drawback to such a device is that the tool requires the user to hammer the seal closed and to return a gripper portion to a home position to remove the band and to tension a subsequent band. In addition, there is no consistent way in which to determine the initial tension of the band on the hose.

Another tool is a manual tool in which a lead screw is used to facilitate tensioning. In this tool, again, there is no way in which to determine whether proper tension has been reached. In addition, if the lead screw has been fully threaded but tension has not yet been reached, the gripper has to be reset to complete tensioning.

Other tools have limited take up and/or can only be used in low tension systems. In other tools, tension in the band may be released or reduced when the band is either cut or moved to a position to be cut and/or sealed.

Accordingly, there is a need for a tool or an attachment for the tool for tensioning, cutting, and/or sealing a hose clamp or band while minimizing tension loss in a clamping loop formed by the band. In addition, it may be desirable to provide a tool or attachment for the tool to punch the seal on a hose clamp or band while the band is tensioned. Further still, it may be desirable to provide interchangeable attachments for the tool to perform different functions, such as tensioning, cutting, sealing and/or punching.

SUMMARY

According to one aspect, there is provided an attachment for a tool for tensioning, cutting and/or punching a band-type clamp. The tool includes a nose piece into which a tail of a band for tensioning around a load is fed and the attachment includes a main body configured for attachment to the tool, the main body having a band guide slot extending in a direction in which the band is fed and a blade guide intersecting the band guide slot. The attachment also includes a blade having a contact surface and a cutting edge, the blade movably positioned in the blade guide, and a blade biasing element positioned in the blade guide between a portion of the blade and the main body to urge the blade in a predetermined direction.

According to another aspect, there is provided a tool for tensioning, cutting and/or punching a band-type clamp. The tool includes a tool body and a nose piece connected to the tool body. The nose piece is configured to receive a tail of a band for tensioning the band around an object. The tool also includes an operating lever having a pivot end pivotably secured to the nose piece, the operating lever having a camming portion at the pivot end and an attachment secured to the nose piece. The attachment includes a main body having a band guide slot extending in a direction in which the band is fed and a blade guide intersecting the band guide slot, a blade having a contact surface and a cutting edge, the blade movably positioned in the blade guide, and a blade biasing element positioned in the blade guide between a portion of the blade and the main body to urge the blade in a predetermined direction. Rotation of the operating lever in a first direction causes the camming portion to contact the contact surface of the blade and move the blade within the blade guide toward the band guide slot.

According to still another aspect, there is provided an attachment for a tool for tensioning, cutting and/or punching a band-type clamp, the tool having a nose piece into which a tail of a band for tensioning around an object is fed. The attachment includes a main body configured for attachment to the tool, the main body having a band guide slot extending in a direction in which the band is fed, a punch mechanism rotatably mounted on the main body, the punch mechanism having a punch guide with a longitudinal passageway and a punch tool at least partially positioned within the passageway and configured for reciprocal movement within the passageway, and a return spring positioned in the passageway configured to urge the punch tool in a predetermined direction.

According to yet another aspect, there is provided a tool for tensioning, cutting and/or punching a band-type clamp. The tool includes a tool body, a nose piece connected to the tool body, the nose piece configured to receive a tail of a band for tensioning the band around load, and an attachment secured to the nose piece. The attachment includes a main body having a band guide slot extending in a direction in which the band is fed, a punch mechanism rotatably mounted on the main body, the punch mechanism including a punch guide having a longitudinal passageway and a punch tool at least partially positioned within the passageway and configured for reciprocal movement within the passageway, and a return spring positioned in the passageway configured to urge the punch tool in a predetermined direction. The punch tool is configured to receive an external force to move the punch tool within the punch guide to impact and punch the band.

According to still another aspect, there is provided a method of forming a clamp from a band of material with a tool for tensioning, cutting and/or punching the band. The tool includes a tool body and a nose piece connected to the tool body. The nose piece is configured to receive a tail of the band for tensioning the band around an object. The tool also includes an operating lever pivotably secured to the nose piece, the operating lever having a camming portion at a pivot end and an attachment secured to the nose piece. The attachment includes a main body having a band guide slot extending in a direction in which the band is fed and a blade guide intersecting the band guide slot. The attachment further includes a blade having an external contact surface and a cutting edge, the blade movably positioned in the blade guide, and a blade biasing element positioned in the blade guide between a portion of the blade and the main body to urge the blade in a predetermined direction. The method includes forming the band into a loop, disposing a buckle on the band so that the loop defines a clamp and a tail extends from the clamp, inserting the tail into the band guide slot of the attachment, rotating the clamp or tool so as to form a transverse bend in the tail, actuating the operating lever to cut the tail with the blade, folding over a remaining portion of the tail on to the buckle and/or band material, and folding opposing tabs of the buckle on to the folded over remaining tail.

According to yet another aspect, there is provided a method of punching a seal in a band of material with a tool for tensioning, cutting and/or punching a band-type clamp, the band having a clamp loop and a tail. The tool includes a tool body and a nose piece connected to the tool body. The nose piece is configured to receive the tail of the band for tensioning the band around a load. The tool also includes an attachment secured to the nose piece. The attachment includes a main body having a band guide slot extending in a direction in which the band is fed, a punch mechanism rotatably mounted on the main body, the punch mechanism having a punch guide with a longitudinal passageway and a punch tool at least partially positioned within the passageway and configured for reciprocal movement within the passageway. The attachment also includes a return spring positioned in the passageway configured to urge the punch tool in a predetermined direction. The method includes inserting the tail of the band into the attachment and the nose piece, tensioning the clamp of the band with the tool, applying an impact to the punch tool to drive the punch tool within the punch guide so as to punch the band at a seal and rotating the clamp or the tool back-and-forth to separate the tail from the clamp.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
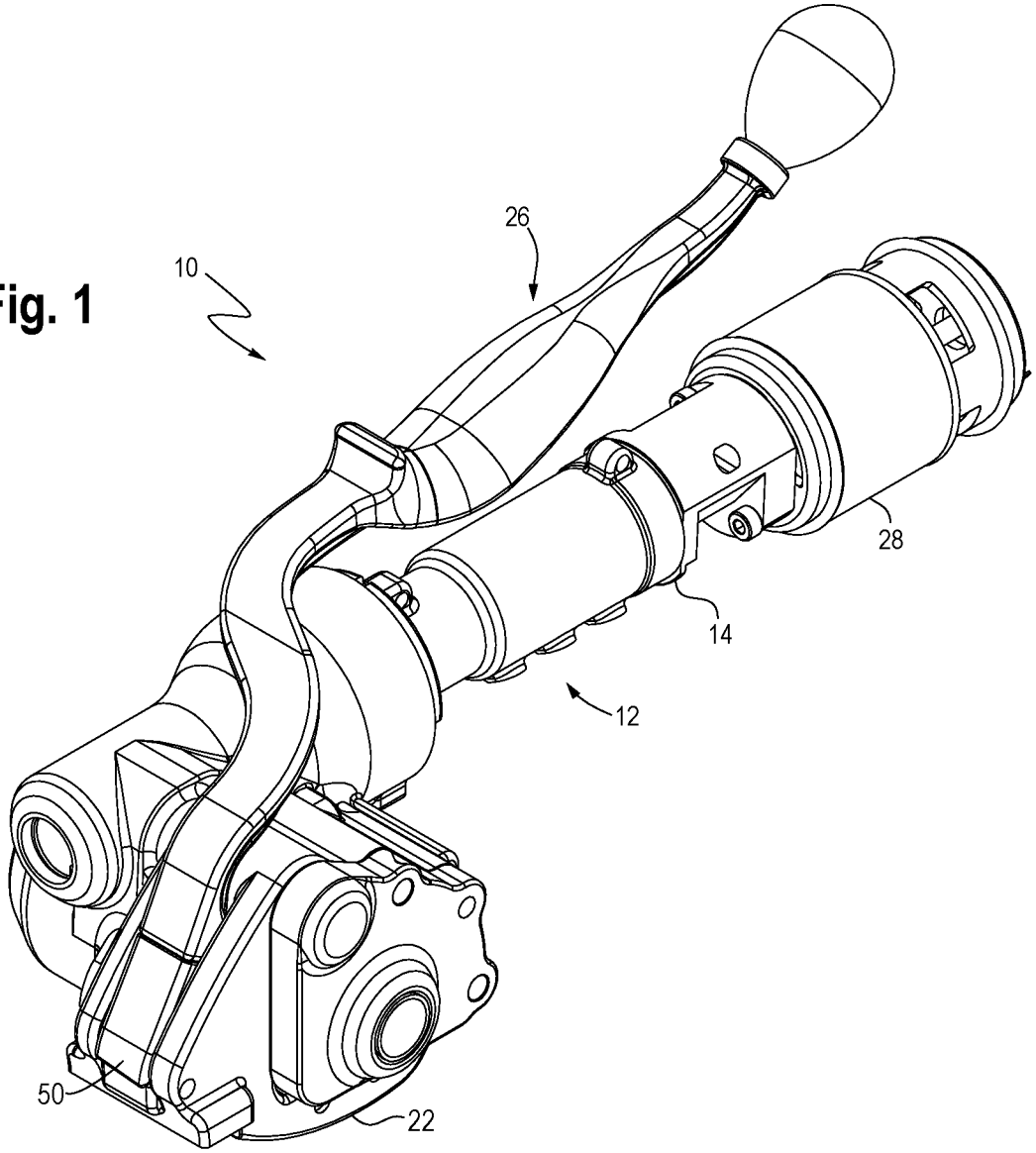
FIG. 1 is a perspective view of a tool for tensioning, cutting and/or punching a hose clamp according to an embodiment described herein.
Figure 2:
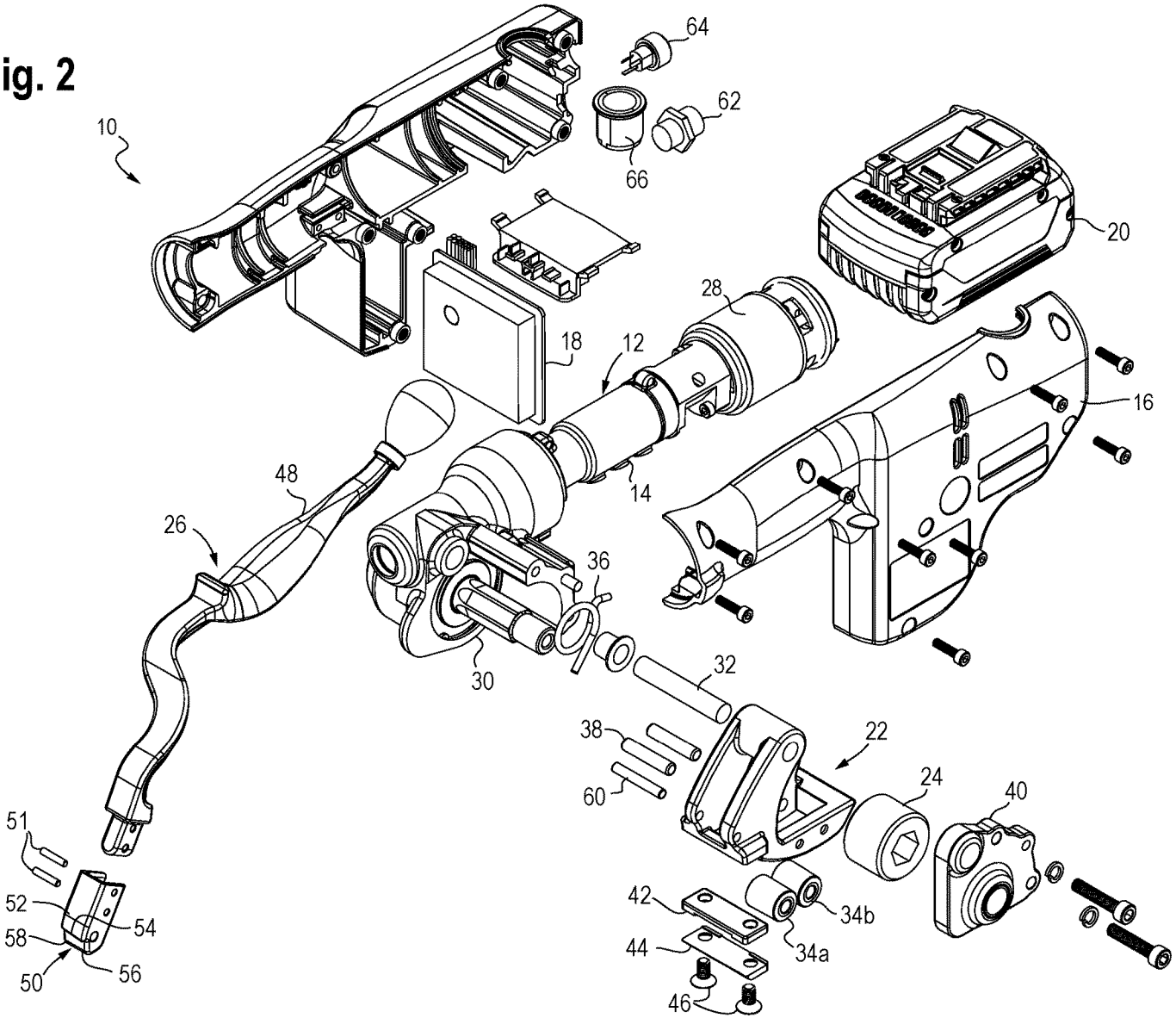
FIG. 2 is an exploded perspective view of the tool of FIG. 1.

FIG. 1 is a perspective view of a tool 10 for tensioning, cutting and/or punching a hose clamp or band, the tool 10 being of the type described and disclosed in Skonieczny, Jr., et al., U.S. Patent Application Publication No. 2013/0269824, which is incorporated by reference herein, in its entirety. FIG. 2 is an exploded view of the tool 10 of FIG. 1.

Figure 6:
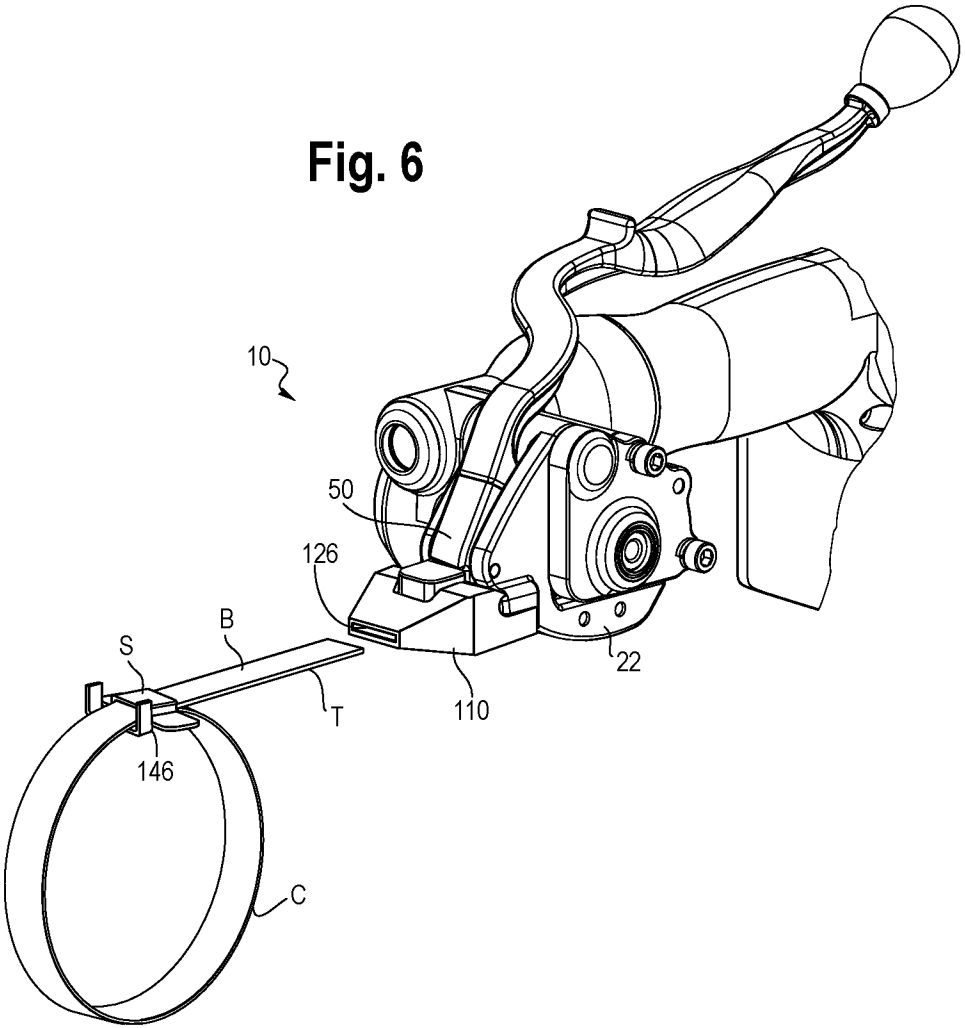
FIG. 6 is a perspective view of the tool of FIG. 1 with the attachment of FIG. 3.

Referring to FIGS. 1 and 2, there is shown a tool 10 for tensioning, cutting and/or punching hose clamps C (see FIG. 6). The tool 10, i.e., the tensioner/cutter tool, is used to tension a band B (see FIG. 6) around a hose (not shown) or other load. In one embodiment, the band B is formed in a loop around the hose, such that the loop forms the hose clamp C. The band B may include a tail T that extends from the clamp C. One embodiment of the tool 10 includes, generally, a body 12 that encloses a powertrain 14, a housing 16 which houses the body 12 and a controller 18, a power supply 20, for example, a battery pack, a nose piece 22, a feed or tension wheel 24 and an operating lever 26.

A motor 28 is operably connected to the powertrain 14, which in turn is operably connected to the feed wheel 24 by a drive shaft 30. The powertrain 14 converts the rotational movement of the motor 28 to provide a desired power (torque) to the feed wheel 24 for tensioning of the band B.

The nose piece 22 is a carriage that is moveably mounted or connected to the tool body 12, preferably pivotally mounted, by a pivot pin 32. The nose piece 22 includes a pair of rollers 34*a* and 34*b* which function as pinch wheels to pinch the band B between the rollers 34*a* and 34*b* and the feed wheel 24. The nose piece 22 is mounted to the body 12 by a biasing element 36, such as the illustrated spring to bias the rollers 34*a* and 34*b* toward and into contact with the feed wheel 24. The rollers 34*a* and 34*b* are mounted to the nose piece 22 by roller pins 38. Two rollers 34*a* and 34*b* are provided to increase the surface area over which the band B contacts the feed wheel 24. This can reduce milling of the band B and allow tension to be drawn on softer band B materials.

A connecting plate 40 mounts to an end of the drive shaft 30 and to the pivot pin 32 that mounts the nose piece 22 to the body 12. In this arrangement, the feed wheel 24 and nose piece 22 are secured to the tool 10, and the nose piece 22 can pivot about the pivot pin 32 to bring the rollers 34*a* and 34*b* into contact with the feed wheel 24.

An alignment or guide plate 42 is mounted to a front lower portion of the nose piece 22. The alignment plate 42 is configured to provide a guide for the tail T of the band B (see FIG. 6) to be positioned in the tool 10. A shear plate 44 is positioned adjacent to and below the alignment plate 42. The shear plate 44 defines a lower portion of the guide and also serves as an anvil against which the band B is held during a cutting operation. The alignment plate 42 and shear plate 44 can be secured to the nose piece 22 by fasteners 46, such as the illustrated screws.

The operating lever 26 is mounted to the nose piece 22. The lever 26 includes an elongated handle 48 and a camming portion 50. The camming portion 50, which is at a pivot end of the lever 26 may include a cradle 52 that includes a lip 54, a support surface 56 and a pivot or contact corner 58. The lever 26 is mounted to the nose piece 22 by a pivot pin 60. The camming portion 50 can be an element separate from the lever 26 and secured thereto by fasteners or pins 51 to facilitate replacement of the cutter portion 50. Alternatively, the camming portion 50 can be formed integral with the lever 26.

In use, a band B having a clamp C and a seal S (see FIG. 6) is positioned around a hose (not shown) and fitting. The operating lever 26 is urged toward the tool body 12 to pivot the nose piece 22 which moves the rollers 34*a* and 34*b* away from the feed wheel 24, opening the gap. The end tail T of the band B is positioned between the feed wheel 24 and the rollers 34*a* and 34*b* and the lever 26 is released.

The motor 28 is actuated to turn the feed wheel 24. The spring 36 biases nose piece 22 and thus the roller 34*a* and 34*b* toward the feed wheel 24 to capture the end tail T between the feed wheel 24 and the rollers 34*a* and 34*b*. In addition, as the seal S begins to move into the nose piece 22, the clamping force on the band B is increased by further urging the nosepiece 22 (and rollers 34*a* and 34*b*) against the band B and into the feed wheel 24.

As the feed wheel 24 rotates, it draws tension in the band B, tightening the band B, and in particular, the clamp C, around the hose. When a predetermined tension is reached, the motor 28 stops, but the drivetrain 14 maintains tension in the band B. The feed wheel 24 then reverses slightly, but not so much as to lose tension in the band B. The motor 28 may be operatively connected to, and controlled by, the controller 18, such that the controller 18 may stop the motor 28 when a desired tension is reached. It is understood that this is example is non-limiting, and the motor may be operated and controlled by other mechanisms, for example, a manually operated dial or trigger.

Referring to FIGS. 3-20, an attachment for cutting or punching the band B may be secured to the nose piece 22 of the tool 10. The attachment may be formed as either a band and buckle attachment 110 (see FIGS. 3-12) for cutting the band B or a band punch attachment 310 (see FIGS. 13-20) for punching the band B.

Figure 4:
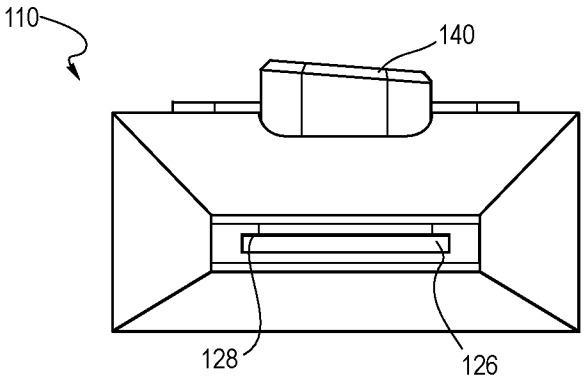
FIG. 4 is a front view of the attachment of FIG. 3.
Figure 5:
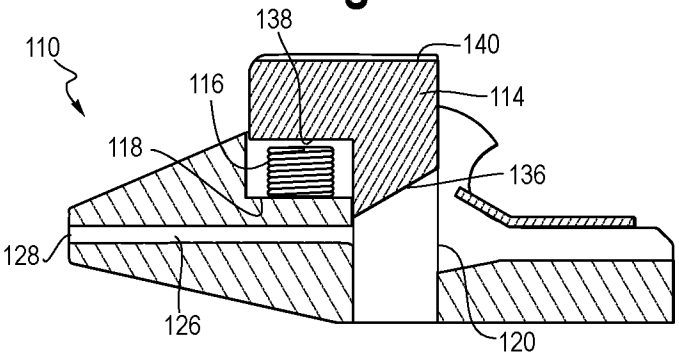
FIG. 5 is a cross section view of the attachment of FIG. 3.
Figure 3:
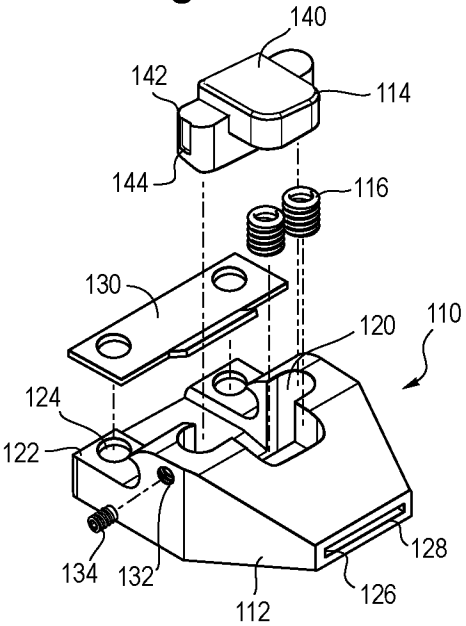
FIG. 3 is an exploded perspective view showing an example of a band and buckle attachment for the tool of FIG. 1 according to an embodiment described herein.

Referring to FIGS. 3-12, and in particular, FIGS. 3-5, the band and buckle attachment 110 includes a main body 112, a blade 114 and a blade biasing element 116 disposed between the main body 112 and blade 114. The main body 112 includes a seat 118 for the biasing element 116. The seat 118 is formed in a blade guide 120 which guides motion of the blade 114. The biasing element 116 may be, for example, one or more compression springs configured to urge the blade 114 outwardly from the blade guide 120. In one embodiment, the biasing element 116 is formed as two compression springs.

The main body 112 further includes a mounting section 122 configured to be secured to the nose piece 22 of the tool 10. The mounting section 122 may include, for example, one or more openings 124 configured to receive a fastening element, such as, but not limited to, a threaded fastener. In one embodiment, the main body 112 may be secured to the nose piece 22 by the screws 46 described above and shown in FIGS. 1 and 2.

The main body 112 also includes a band guide slot 126 extending through the main body 112 and having an open end 128 configured to receive the band B. The band guide slot 126 defines a path along which a tail T of the band B may be received, held and fed to nose piece 22 of the tool 10 for tensioning of the band B. The band guide slot 126 may be defined, at least in part, by the mounting section 122 and the alignment plate 42. It is understood that the alignment plate 42 described above and shown in FIGS. 1 and 2 may be used together with the main body 112 of the band and buckle attachment 110. Alternatively, the band and buckle attachment 110 may include an alignment plate 130 to be used with, or in place of, the alignment plate 42 above. In the embodiment shown in FIGS. 3-5, the mounting section 122 may replace the shear plate 44 shown and described above in FIGS. 1 and 2.

The main body 112 may also include a lateral fastening bore 132 formed in one side thereof. In one embodiment, the fastening bore 132 is formed in a lateral side of the main body 112 and extends along an axis extending transverse to a longitudinal direction of the band B, i.e., a direction in which the band B is fed. The fastening bore 132 is configured to receive a retaining fastener 134, such as a threaded fastener, including, but not limited to, a set screw. The retaining fastener 134 may be received in, and extend through, the main body 112, and into the blade guide 120.

The blade 114 includes a cutting edge 136 configured to engage and cut the tail T of the band B received in the band guide slot 126. The blade 114 may also include a blade seat 138 opposing the main body seat 118. Accordingly, one side of the blade biasing element 116 may be seated against the seat 118 of the main body 112 (formed within the blade guide 120), and another side of the biasing element 116 may be seated against the blade seat 138. The blade 114 may further include a contact surface 140 that is configured to be engaged by the operating lever 26. In one embodiment, the contact surface is contacted by the camming portion 50 of the operating lever 26 to move the blade 114 in the blade guide 120. The contact surface 140 is formed at an opposite side of the blade 114 from the cutting edge 136. In one embodiment, the contact surface 140 may angled at a non-perpendicular angle relative to an axis of movement of the blade 114. However, the present disclosure is not limited to this configuration.

The blade 114 may further include a slotted retaining recess 142 having an end wall 144. The retaining fastener 134 may be received in the slotted retaining recess 142 on the blade 114. The retaining fastener 134 may abut against the end wall 144 of the slotted retaining recess 142 to retain blade 114 in the blade guide 120 to limit movement of blade 114 in one direction. That is, the retaining fastener 134 is configured to retain the blade 114 in the blade guide 120 against the biasing force from the biasing element 116. In one embodiment, the biasing element 116 biases the blade 114 outwardly from the blade guide 120, so that the contact surface 140 projects outwardly from the blade guide 120.

FIG. 6 is a perspective view of the tool 10 with the band and buckle attachment 110 secured thereon. It is understood that although the tool 10 and band and buckle attachment 110 may be referred to separately, that that tool 10 and attachment 110 together, in combination, be considered as the tool 10 as well. That is, the band and buckle attachment 110 may be considered to be part of the tool 10.

To secure the band and buckle attachment 110 on the tool 10, the band and buckle attachment 110 may be properly positioned relative to the nose piece 22, such that the mounting section 122, and in particular, the openings 124 of the mounting section 122, are aligned with corresponding openings on the nose piece 22. The alignment plate 42 (or 130) is positioned between the mounting section 122 and the nose piece 22. The fasteners, for example, the screws 46 may then be inserted through mounting section 122, the alignment plate 42 (or 130) and received in the nose piece 22 to secure the band and buckle attachment 110 to the nose piece 22 (see FIG. 10).

Figure 7:
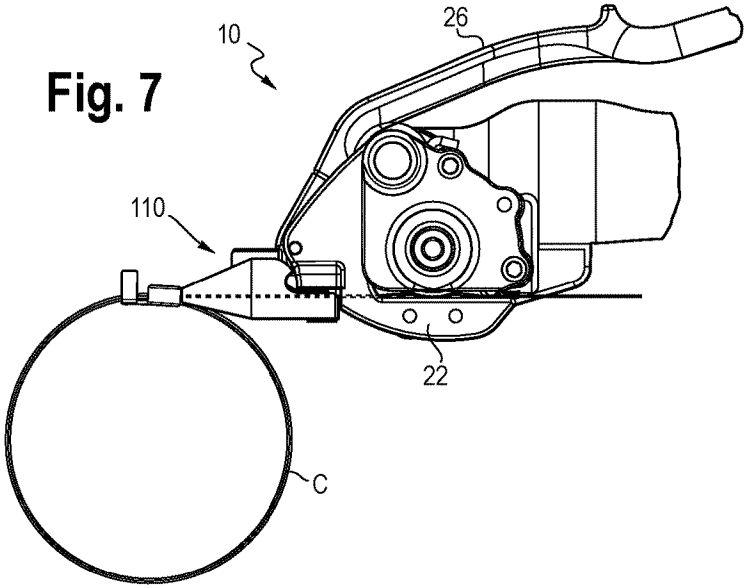
FIG. 7 is a side view of the tool of FIG. 1 with the attachment of FIG. 3 having a band received therein, according to an embodiment described herein.

FIG. 7 is a side view of the tool 10 and band and buckle attachment 110 with the band B positioned therein. Referring to FIGS. 6 and 7, in one embodiment, the tail T of the band B is inserted into the band and buckle attachment 110 through the band guide slot 126. The tail T of the band B is positioned between the feed wheel 24 and the rollers 34*a* and 34*b*, and the band B may be tensioned as described above.

Figure 8:
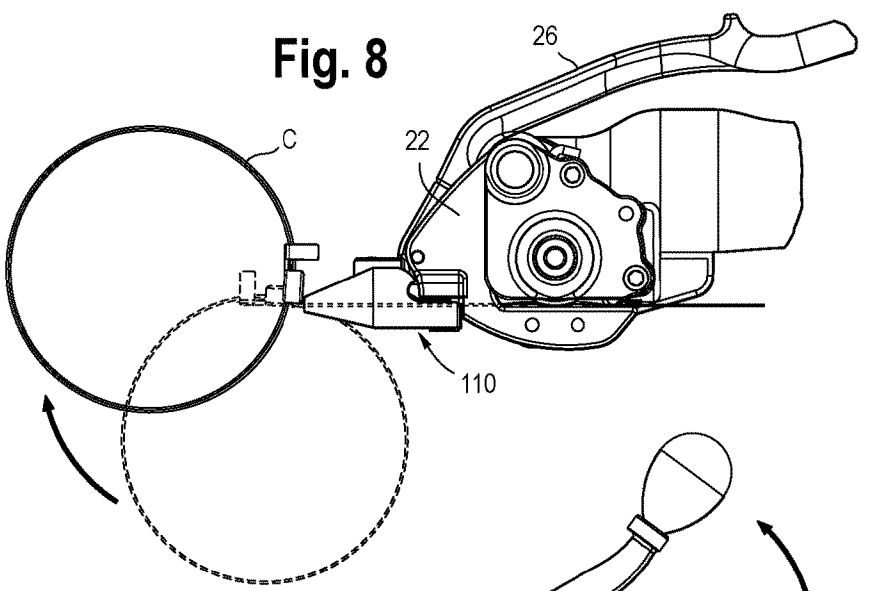
FIG. 8 is a side view of the tool and attachment of FIG. 7 with the band rotated relative to the tool and attachment.
Figure 9:
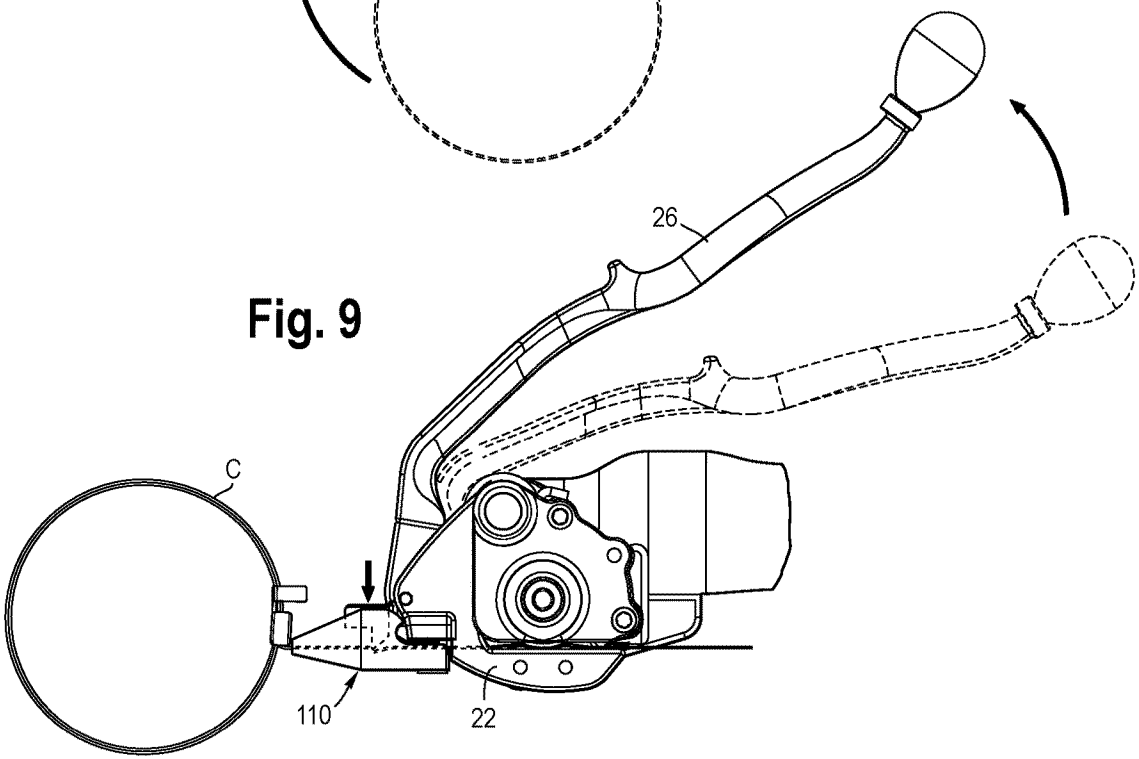
FIG. 9 is a side view of the tool and attachment of FIG. 8, showing rotation of an operating lever.
Figure 10:
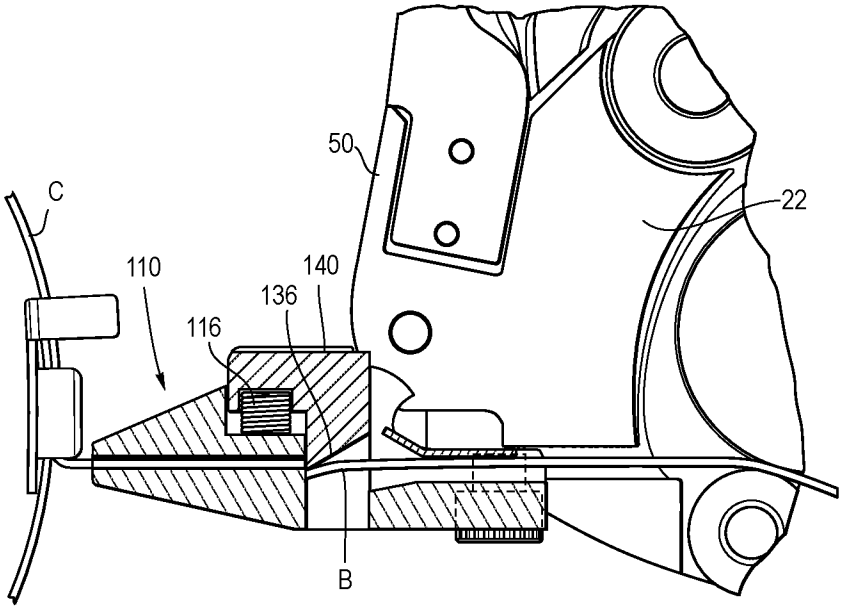
FIG. 10 is a side cross-sectional view of the tool and attachment of FIGS. 7-9 in a cutting position.

FIGS. 8-10 show the tool 10 with band and buckle attachment 110 secured thereto, during a cutting operation, according to an embodiment described herein. As shown in FIG. 8, the band B may be rotated so as to form a transverse bend in the tail T. The operating lever 26, as shown in FIG. 9, may be rotated to actuate the blade 114 to cut the tail of the band B within the band and buckle attachment 110.

FIG. 10 is a cross-sectional view of the nose piece 22 of the tool 10 and the band and buckle attachment 110 during the cutting operation. Referring to FIG. 10, in one embodiment, the camming portion 50 of the operating lever 26 may apply a force to the contact surface 140 of the blade 114 in response to rotation of the operating lever 26 in one direction. The force is sufficient to overcome the biasing force of the biasing element 116 and move the blade 114 against the biasing element 116 within the blade guide 120. Continued movement of the blade 114 within the blade guide 120 brings the cutting edge 136 into contact with the tail T of the band B. Upon sufficient application of force, via rotation of the operating lever 26, the cutting edge 136 is configured to cut through the tail T. Upon release of the lever 26, or rotation of the lever 26 in an opposite direction, the force may be released from the contact surface 140, and the blade biasing element 116 may urge the blade 114 away from the band guide slot 126 such that the blade 114 is moved outwardly in the blade guide 120 until the end wall 144 abuts the retaining fastener 134.

Figure 11:
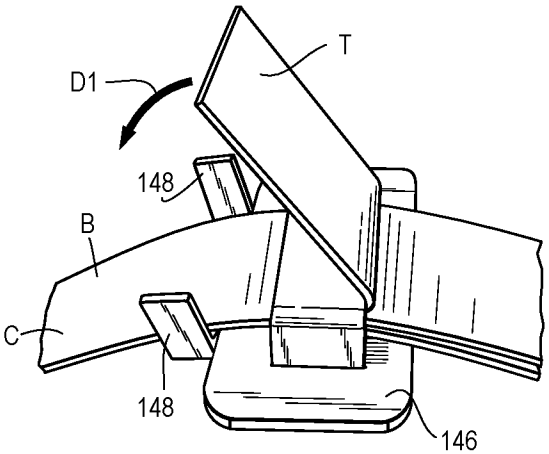
FIG. 11 is a perspective view of a band and buckle after a cutting operation performed by the tool and attachment of FIGS. 7-10, according to an embodiment described herein.
Figure 12:
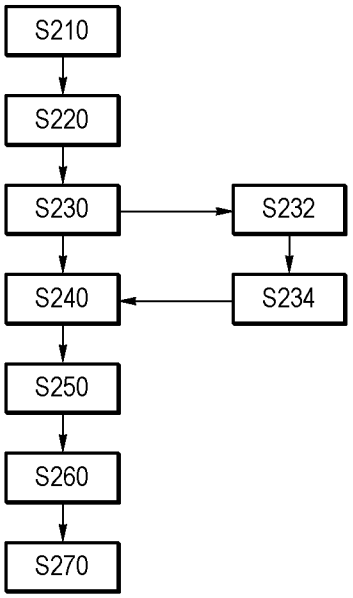
FIG. 12 is a diagram showing a method of forming a clamp from a band of material using the tool and attachment of FIGS. 7-10, according to an embodiment described herein.

FIG. 11 shows the band B together with a buckle 146 after the cutting operation to form the seal S of the clamp C. Referring to FIG. 12, a portion of the tail T remaining after the cutting operation may be folded over in a first direction D1 onto band B at the buckle 146. The buckle 146 is positioned on the band B to form the clamp C and allow relative movement of segments of the band B to tension the band B. Opposing tabs 148 of the buckle 146 may be folded down onto the tail T to secure the tail T against band B and form the seal S.

FIG. 12 shows a method of forming a clamp C from a band B of material using the tool 10 and band and the buckle attachment 110 described above. At S210, the band B of material is formed into a loop L. At S220, the buckle 146 is disposed on the band B to define the loop L with the tail T extending outward from the loop L. The clamp C is formed by the loop L. At S230, the tail T is inserted into the band guide slot 126 of the band and buckle attachment 110. At S232, if the loop L is to be tensioned, the tail is inserted into the nose piece 22 of the tool 10, between the feed wheel 24 and the rollers 34*a* and 34*b*, and at S234, the tool 10 is operated to tension the loop L. At S240, the clamp C or tool 10 is rotated so as to form a transverse bend in the tail T. At S250, the tail T is cut by the blade 114, in response to actuation of the operating lever 26. At S260, the remaining tail T may be folded over the buckle 146 and/or onto the loop L or band B. At S270, opposing tabs 148 on the buckle 146 may be folded over the tail T to complete the seal.

Figure 13:
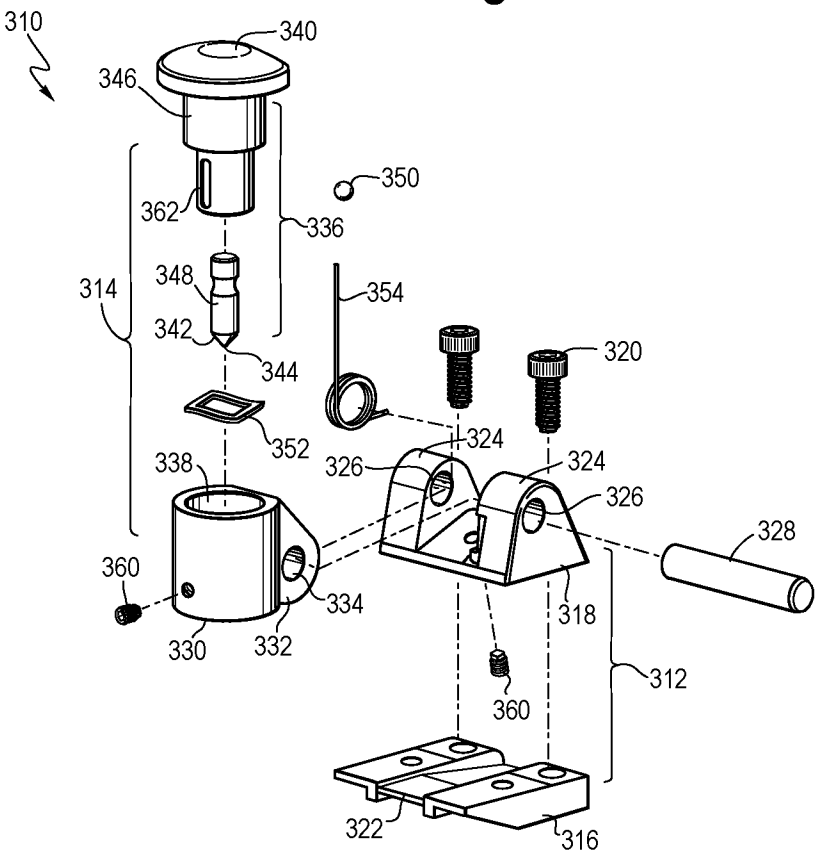
FIG. 13 is an exploded view showing an example of a band punch attachment for the tool of FIG. 1 according to an embodiment described herein.
Figure 16:
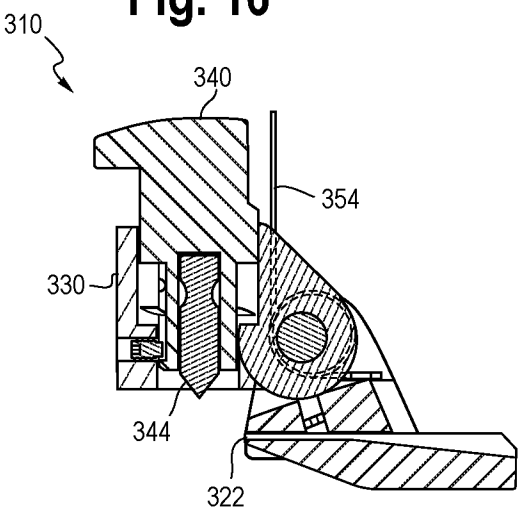
FIG. 16 is a right side cross-sectional view of the attachment of FIG. 14.
Figure 15:
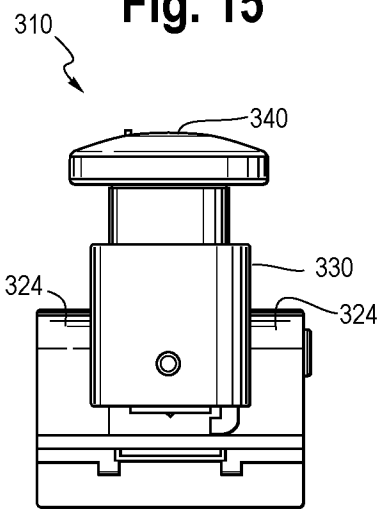
FIG. 15 is a front view of the attachment of FIG. 14.
Figure 14:
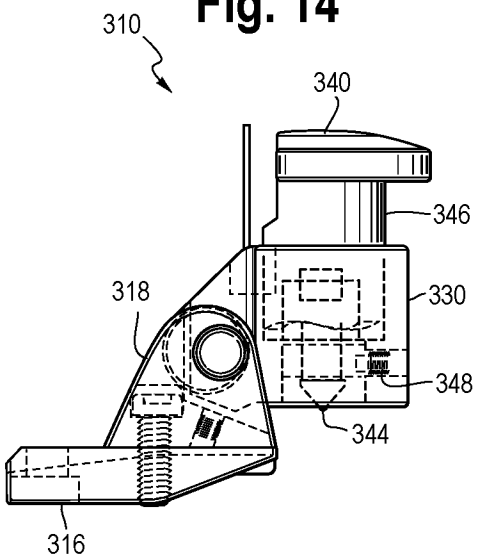
FIG. 14 is a left side view of the attachment of FIG. 14.

Alternatively, with reference to FIGS. 13-20, a band punch attachment 310 may be secured to the free end of the nose piece 22 of the tool 10. The band punch attachment 310 and the band and buckle attachment 110 may be alternately and interchangeably used with the tool 10. FIG. 13 is an exploded view of the band punch attachment 310 according to one embodiment. FIG. 14 is left side view, FIG. 15 is a front view and FIG. 16 is a right side cross-sectional view of the band punch attachment 310 of FIG. 13. It is understood that although the tool 10 and band punch attachment 310 may be referred to separately, that that tool 10 and attachment 310 together, in combination, be considered as the tool 10 as well. That is, the band punch attachment 310 may be considered to be part of the tool 10.

Referring to FIGS. 13-16, the band punch attachment 310 includes a main body 312 and a punch mechanism 314 rotatably secured to the main body 312. In one embodiment, the main body 312 includes a mount base 316 and a guide mount 318. The main body 312 may be formed as a one piece construction, or the mount base 316 and guide mount 318 may be formed separately and secured together using suitable known fastening methods. For example, the mount base 316 may be secured to the guide mount 318 using at least one cap screw 320. A band guide slot 322 is defined between the mount base 316 and guide mount 318. The band guide slot 322 may be formed by, for example, a longitudinally extending slot formed in the mount base 316. The band guide slot 322 is configured to receive a portion of the band B, for example, the tail T.

The guide mount 318 may include opposed ears 324, each ear having an opening 326 therein. The respective openings 326 may be axially aligned and configured to receive a pivot pin 328 therethrough. The opposed ears 324 are spaced from one another.

Still referring to FIGS. 13-16, the punch mechanism 314 is rotatably mounted to the main body 312. In one embodiment, the punch mechanism 314 includes a punch guide 330 having a knuckle 332 with an opening 334 formed therein. The knuckle 332 may be positioned between the opposed ears 324 of the guide mount 318 such that the respective openings 326 of the opposed ears 324 and the opening 334 of the knuckle 332 are aligned. The pivot pin 328 may be received in the openings 326, 334 of the opposed ears 324 and the knuckle 332 to rotatably couple the punch mechanism 314 to the main body 312.

The punch mechanism 314 includes a punch tool 336. The punch guide 330 may also include a longitudinal passageway 338 formed therein. The longitudinal passageway 338 of the punch guide 330 is configured to receive and guide the punch tool 336 for reciprocal movement within the punch guide 330. The punch tool 336 includes a contact surface 340 and a punch surface 342. The contact surface 340 is configured to receive an external force, for example from a hammer or similar impact tool, to drive the punch tool 336 within the passageway 338. The punch surface 342 may be positioned at an end of the punch tool 336 opposite from the contact surface 340. The punch surface 342 includes an impact head 344. In one embodiment, the impact head 344 may be formed as a point or tip. However, it is understood that different configurations are also envisioned. The impact head 344 is configured to selectively engage the band B to punch an indentation into the band B.

In one embodiment, the punch tool 336 may be formed in two parts: a punch head 346 and a punch tip 348. The contact surface 340 is formed on the punch head 346 and the impact head 344 is formed on the punch tip 348. At least a portion of the punch tip 348 may be received within the punch head 346, and secured therein using a known suitable fastener, such as, but not limited to, a ball bearing 350. The punch head 346 may be retained in the punch guide 330 by one or more set screws 360, received in respective retaining slots 362 on the punch head 346. The set screws 360 allow for movement of the punch head 346 in the passageway 338 while retaining the punch head 346 against inadvertent removal from the punch guide 330.

A return spring 352 may be positioned in the punch guide 330. In one embodiment, the return spring 352 is positioned in the longitudinal passageway 338 of the punch guide 330. The punch tool 336 is positioned in the punch guide 330 with the punch tip 348 extending through a central opening of the return spring 352.

The assembled punch mechanism 314, i.e., the punch guide 330 and punch tool 336, may be positioned relative to the guide mount 318 such that the external knuckle 332 of the punch guide 330 is positioned between the spaced apart opposing ears 324 of the guide mount 318. The pivot pin 328 is then inserted through the respective openings 326, 334 of the spaced apart opposing ears 324 and the external knuckle 332. Accordingly, the punch mechanism 314 may be rotated relative to the guide mount 318, and in turn, the main body 312, about an axis defined by the pivot pin 328 between a first position (see FIGS. 14-16) and a second position as described below with reference to FIG. 19.

The band punch attachment 310 further includes a stabilizing spring 354. The stabilizing spring may be, for example, a torsion spring having a first end abutting the main body 312 and a second end abutting the punch mechanism 314. The stabilizing spring 354 is configured to urge the punch mechanism 314 to, and maintain the punch mechanism in, the first position (see FIGS. 14-16) until a sufficient force is applied to rotate the punch mechanism to the second position (see FIG. 19). In one embodiment, one end of the stabilizing spring 354 is placed in a catch on the punch guide 330.

Figure 17:
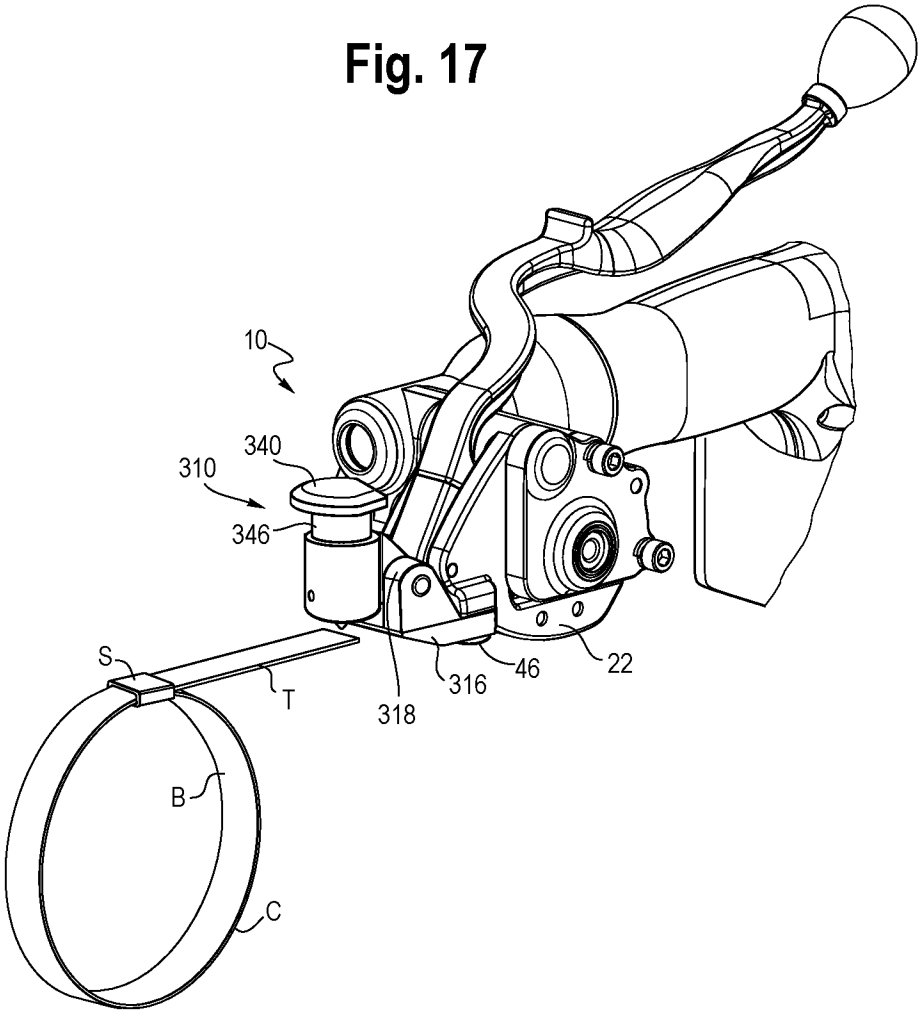
FIG. 17 is a perspective view of the tool of FIG. 1 and the attachment of FIGS. 13-16 secured together, according to an embodiment described herein.

FIG. 17 is a perspective view of the tool 10 having the band punch attachment 310 secured thereto. The band punch attachment 310 may be secured to the tool 10 with one or more fasteners 46 inserted through the main body 312 and received in the tool 10.

Referring still to FIG. 17, the tail T of the band B may be fed into the band guide slot 322 (shown in FIGS. 14-16) of the band punch attachment 310. The band B may be formed in a loop to define a clamp C with the tail T extending therefrom. A seal S formed on the band B defines the clamp C and a boundary between the clamp C and the tail T. The seal S may be formed by joining overlapping parts of the band B together. For example, overlapping portions of the band B may be joined together by an additional piece of material secured around the overlapping portions. The tail T may be inserted into the band guide slot 322 and fed into the nose piece 22 of the tool 10 for tensioning. The seal S may be finished after tensioning, to prevent or limit loss of tension on the clamp C.

Figure 18:
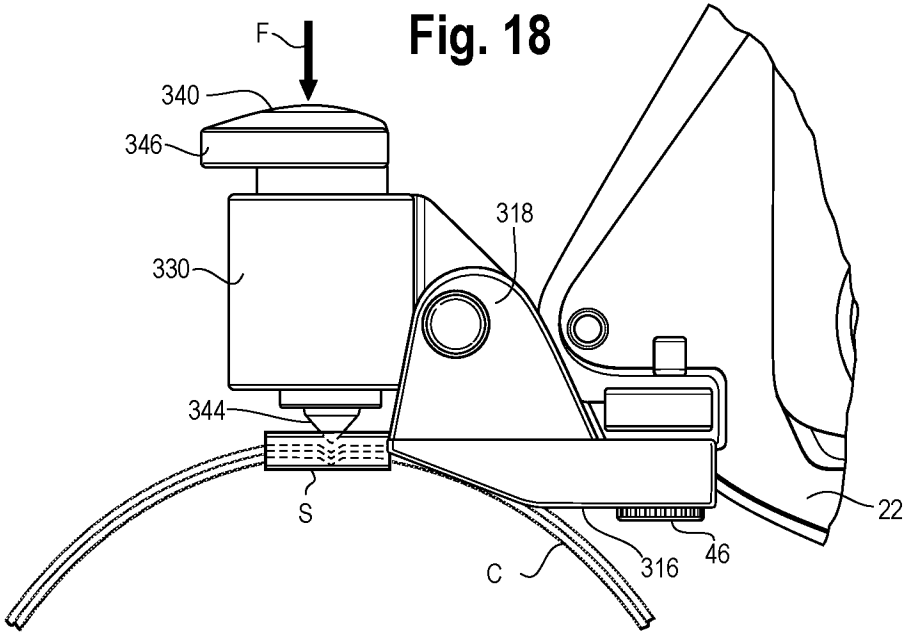
FIG. 18 is a side view of the tool and the attachment of FIG. 17 with the band positioned therein and the attachment in a first rotational position.

FIG. 18 is a side view of the band punch attachment 310 and a portion of the tool 10 having the band B received therein. Referring to FIGS. 14-18, the tail T of the band B may be received in the band guide slot 322 of the band punch attachment 310. The seal S may be moved into position close to or abutting the band punch attachment, such that punch mechanism 314 may be actuated to impact the seal S. As shown in FIG. 18, a force F may be applied to the contact surface 340 of the punch head 346, causing the punch head 346 and punch tip 348 to move within the punch guide 330 toward the seal S. The punch surface 342, and in particular, the impact head 344, may impact the seal S. An indentation or punch mark may then be formed on the seal S. The indentation may serve as a visual indicator or confirmation of the position of the seal. In addition, the impact and deformation imparted on the seal S to form the indentation may be transferred through the seal S to an underlying layer of the band B within the seal S to improve the strength of the seal S.

Figure 19:
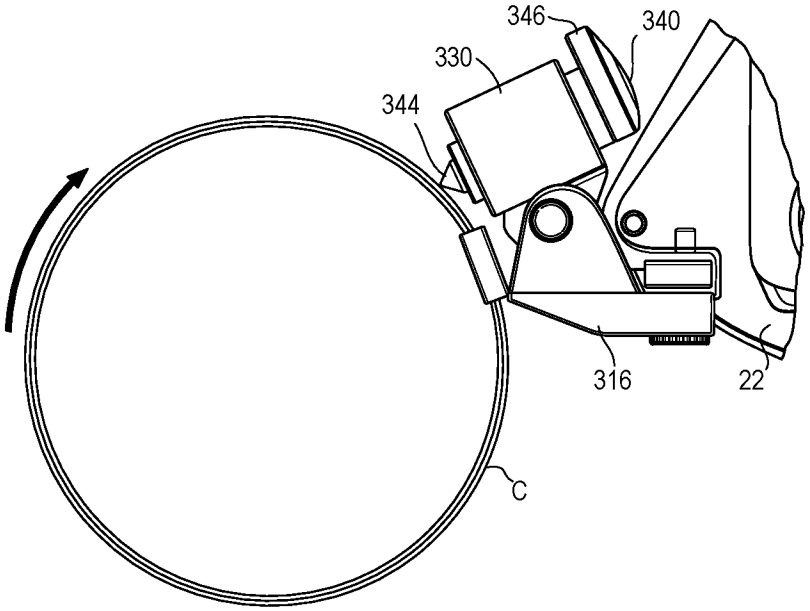
FIG. 19 is an enlarged side view of the tool and the attachment of FIG. 18 with the attachment rotated to a second position.

FIG. 19 shows the punch mechanism 314 rotated to the second position. In one embodiment, the punch mechanism 314 is rotatable between the first and second positions, together with the clamp C to cut the band B at the tail T adjacent to the seal S. For example, the clamp C may be rotated in the direction shown in FIG. 19 to form a bend in the tail T adjacent to the seal S. The clamp C may then be rotated in a direction opposite to that shown in FIG. 23. The back-and-forth rotations may continue until the bend in the tail T is fatigued to a point where the tail T separates from the clamp C.

Figure 20:
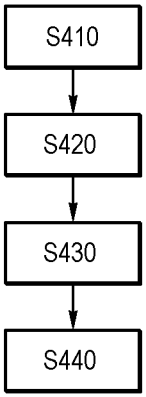
FIG. 20 is a diagram showing a method of punching a seal with the tool and attachment according to an embodiment described herein.

FIG. 20 shows a method of punching the seal S in the band B. At S410, the tail T of the band B is inserted into the band punch attachment and fed between the feed wheel 24 and rollers 34. The operating lever 26 may be squeezed to during this step so as to allow adequate clearance for the tail T to be received between the feed wheel 24 and the roller 34. At S420, the band B, and in particular, the clamp C, may be tensioned by the tool 10, as described above. At S430, upon completion of the tension cycle, the impact force may be applied to the punch tool 336 at the punch head 346 to form the indentation 358 on the seal. At S440, either the tool 10 or the clamp C may be rotated back-and-forth to separate the clamp C from the tail T. The tail T may be removed from the tool 10 and the band punch attachment 310 by squeezing the operating lever 26, thereby releasing a holding force applied to the tail T by the feed wheel 24 and roller 34.

Referring again to FIG. 2, the tool 10 may further include a tension select knob 62. The tension select knob 62 may be, for example, a manual or electronic dial, knob, button or the like can be rotated, pressed or otherwise actuated or operated to set the desired tension. Indicators 64, such as LEDs may be used to provide visual indication of the cycle of the tool 10, the achievement of the desired tension, as well as other operator indicators, for example, battery 20 power. A trigger or actuating switch 66 closes a circuit to commence the tensioning cycle. The tension select knob 62, indicators 64, and trigger 66 may all be operatively and communicatively connected to the controller 18.

Figure 21:
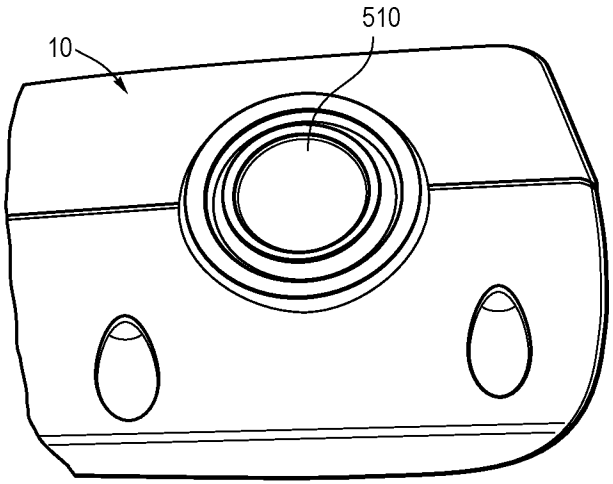
FIG. 21 shows a mode select button on the tool of FIG. 1 according to an embodiment described herein.

FIG. 21 shows a mode select button 510 positioned on the tool for switching the tool 10 between different operating modes depending on the attachment 110, 310 secured thereto. It is understood that the mode select button 510 may be implemented in the tool 10 in addition to the trigger 66, or, alternatively, may replace the trigger 66. It is also understood that the mode select button 510 is not limited to a button configuration. For example, the mode select button may be implemented as a dial, knob, switch or similar device. The mode select button 510 may also be operatively and communicatively connected to the controller 18.

The tension select knob 62 may be moved between different positions corresponding to different desired tension levels. In addition, the tension select knob 62 may be moved to a mode change position. With the tension select knob 62 in the mode change position, the mode select button 510 may be operated as described below to change the operating mode of the tool 10.

Figure 22:
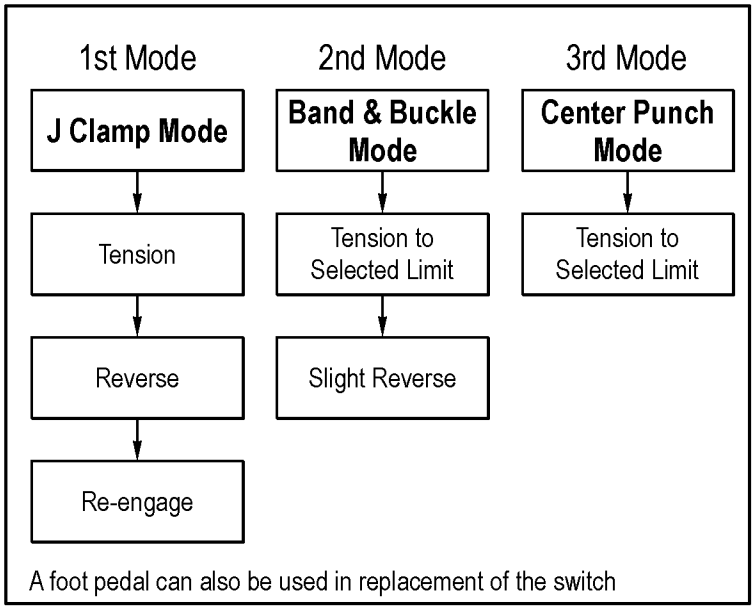
FIG. 22 is a chart showing examples of different functions associated with different operating modes of the tool according to an embodiment described herein.

FIG. 22 is a chart showing functions or operation that may be performed in different operating modes of the tool 10. The operating mode of the tool 10 may be changed between, for example, a first mode, a second mode and a third mode. The first mode may be a J-clamp mode. In the J-clamp mode, the tool 10 may tension, reverse and/or re-engage the band B. The tool 10 may enter the first mode, for example, by pressing the mode select button 510 once. The indicator 64 on the tool 10 may blink one time in response to one press of the mode select button 510 to provide a visual confirmation to a user.

The second mode may be a band and buckle mode. In the band and buckle mode, the tool 10 may tension the band B to the selected or desired limit, and/or slightly reverse the band B. The tool 10 may enter the second mode in response to two presses of the mode select button 510. The indicator 64 may blink two times in response to two presses of the mode select button 510. This mode corresponds to use of the tool with the band and buckle attachment 110 described above.

The third mode may be a band punch mode. In the band punch mode, the tool 10 may tension the band B to the selected or desired limit. The tool 10 may enter the third mode in response to three presses of the mode select button 510. The indicator 64 may blink three times in response to three presses of the mode select button 510. This mode corresponds to use of the tool with the band punch attachment 310 described above.

Once a mode is selected using the mode select button 510, the tension select knob 62 may be moved out of the mode change position to a desired tension level.

In the embodiments above, the attachments 110, 310 may be used to build on a battery operated tool platform that allows use on major clamping systems. The attachments 110, 310 may also allow unlimited take up for a preform center punch and band and buckle clamps. Further, the embodiments above allow for electronically controlled tension, so that custom tension settings are based on preform and band and buckle characteristics. Operating modes, i.e., tensioning scenarios, may be changed for different attachments 110, 310 that are used with tool 10. Further still, repeatable tensioning may be allowed for, reducing user feel. The band and buckle attachment 110 also utilizes an existing handle, i.e., operating lever 26, to actuate the cutting mechanism, i.e., the blade 114. The platform will also allow these attachments 110, 310 to be used while bench mounted.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. An attachment for a tool for tensioning a band-type clamp, the attachment comprising:

a body configured for attachment to the tool and defining a band-guide slot and a blade guide intersecting the band-guide slot;

a blade comprising a contact surface and a cutting edge, the blade positioned in the blade guide and movable relative to the body between a rest position and a cutting position; and a spring supported by the body and biasing the blade to the rest position.

2. The attachment of claim 1, further comprising a retainer that retains the blade in the blade guide when the blade is in the rest position.

3. The attachment of claim 2, wherein the retainer is mounted to the body.

4. The attachment of claim 3, wherein the retainer extends into the blade guide.

5. The attachment of claim 4, wherein the blade defines a retaining recess, wherein the retainer is received in the retaining recess.

6. The attachment of claim 1, wherein the body comprises a mounting section comprising an opening sized to receive a fastener for securing the body to the tool.

7. The attachment of claim 6, wherein the body comprises an open end defining an entrance to the band-guide slot, wherein a height of the open end and a width of the open end are less than a height of the mounting section and a width of the mounting section, respectively.

8. The attachment of claim 1, further comprising an alignment plate connected to the body and at least partially defining the band guide slot.

9. The attachment of claim 1, wherein the spring is positioned between a portion of the blade and a portion of the body.

10. The attachment of claim 9, wherein the spring is positioned in the blade guide.

11. The attachment of claim 1, wherein the blade guide is perpendicular to the band guide.

12. The attachment of claim 1, wherein the contact surface is opposite the cutting edge.

13. The attachment of claim 1, wherein the blade further comprises an end wall that partially defines a retaining recess, the attachment further comprising a retainer mounted to the body, extending into the blade guide, and received in the retaining recess to retain the blade in the blade guide when the blade is in the rest position.

14. The attachment of claim 13, wherein the spring is positioned in the blade guide between a portion of the blade and a portion of the body.

15. An attachment for a tool for tensioning a band-type clamp, the attachment comprising:

a body configured for attachment to the tool and defining a band-guide slot and a blade guide intersecting the band-guide slot;

a blade comprising a contact surface and a cutting edge, the blade positioned in the blade guide and movable relative to the body between a rest position and a cutting position;

a biasing element biasing the blade to the rest position; and a retainer mounted to the body that retains the blade in the blade guide when the blade is in the rest position, wherein the retainer extends into the blade guide.

16. The attachment of claim 15, wherein the blade defines a retaining recess, wherein the retainer is received in the retaining recess.

17. The attachment of claim 16, wherein the blade includes an end wall that partially defines the retaining recess, wherein the end wall contacts the retainer when the blade is in the rest position.

18. The attachment of claim 17, wherein the retainer is stationary relative to the body.

19. An attachment for a tool for tensioning a band-type clamp, the attachment comprising:

a body configured for attachment to the tool and defining a band-guide slot and a blade guide intersecting the band-guide slot;

a blade comprising a contact surface, a cutting edge, and an end wall that partially defines a retaining recess, the blade positioned in the blade guide and movable relative to the body between a rest position and a cutting position;

a biasing element biasing the blade to the rest position; and a retainer mounted to the body, extending into the blade guide, and received in the retaining recess to retain the blade in the blade guide when the blade is in the rest position.

20. The attachment of claim 19, wherein the biasing element is positioned in the blade guide between a portion of the blade and a portion of the body.

* * * * *